US009875871B2

(12) United States Patent
He et al.

(10) Patent No.: US 9,875,871 B2
(45) Date of Patent: Jan. 23, 2018

(54) SOLENOID SWITCH

(71) Applicant: Johnson Electric S.A., Murten (CH)

(72) Inventors: Wan Mei He, Shenzhen (CN); Jun Jie Chu, Hong Kong (CN); Li Bing Liao, Shenzhen (CN)

(73) Assignee: JOHNSON ELECTRIC S.A., Murten (CH)

( * ) Notice: Subject to any disclaimer, the term of this patent is extended or adjusted under 35 U.S.C. 154(b) by 280 days.

(21) Appl. No.: 14/751,840

(22) Filed: Jun. 26, 2015

(65) Prior Publication Data

US 2015/0380192 A1 Dec. 31, 2015

(30) Foreign Application Priority Data

Jun. 26, 2014 (CN) ..... 2014 2 0351131 U

(51) Int. Cl.

| | |
|---|---|
| ***H01H 67/02*** | (2006.01) |
| ***H01H 50/20*** | (2006.01) |
| ***H01H 50/42*** | (2006.01) |
| ***H01H 50/44*** | (2006.01) |
| ***F02N 11/08*** | (2006.01) |

(Continued)

(52) U.S. Cl.

CPC ..... *H01H 50/20* (2013.01); *F02N 11/087* (2013.01); *F02N 11/0851* (2013.01); *F02N 11/0862* (2013.01); *H01H 50/42* (2013.01); *H01H 50/44* (2013.01); *H01H 51/065* (2013.01); *H01H 50/34* (2013.01); *H01H 2235/01* (2013.01)

(58) Field of Classification Search

CPC .... H01H 50/22; H01H 50/44; H01H 2235/01; H01H 67/02; H01H 9/00; F02N 11/0851; F02N 11/0862; H01F 7/00; H01F 7/08; H01F 7/18

USPC ..... 335/126

See application file for complete search history.

(56) References Cited

U.S. PATENT DOCUMENTS 2,820,150 A * 1/1958 Coburn ..... H01H 50/22 307/112

3,433,968 A * 3/1969 Broyden ..... F02N 11/0851 290/37 R (Continued)

FOREIGN PATENT DOCUMENTS

| | | |
|---|---|---|
| CN | 201252059 Y | 6/2009 |
| CN | 201994753 U | 9/2011 |
| JP | 2009-93973 A | 4/2009 |

*Primary Examiner* — Shawki S Ismail

*Assistant Examiner* — Lisa Homza

(74) *Attorney, Agent, or Firm* — Muncy, Geissler, Olds & Lowe, P.C.

(57) ABSTRACT

A starter for an internal combustion engine includes an electric motor and a solenoid switch. The solenoid switch includes a housing, a fixed core, a movable core, two spaced contacts, and a conductive member arranged to interconnect the contacts when the solenoid is turned on. The movable core is connected to a pinion of the motor which is movable to engage with a flywheel of the engine. The fixed core includes a pull-in coil of aluminum wire, a holding coil of copper wire, and a magnetic core. The motor is connected in series with the pull-in coil. When the solenoid is energized, the coils generate a magnetic field that attracts the movable core to the magnetic core, thereby the moving the pinion into engagement with the flywheel and causing the conductive member to interconnect the contacts.

17 Claims, 5 Drawing Sheets

(51) Int. Cl.
*H01H 51/06* (2006.01)
*H01H 50/34* (2006.01)

(56) References Cited

U.S. PATENT DOCUMENTS 3,715,694 A * 2/1973 Kruger ..... H01H 3/222 335/100
4,080,541 A * 3/1978 Mazzorana ..... F02N 11/00 123/179.25
4,213,108 A * 7/1980 Gross ..... H01H 51/065 335/131
4,382,242 A * 5/1983 Colvin ..... H01H 50/023 335/131
4,540,962 A * 9/1985 Gresley ..... H01F 5/04 335/131
4,551,630 A * 11/1985 Stahura ..... F02N 11/0851 123/179.3
4,579,010 A * 4/1986 Colvin ..... F02N 15/067 335/131
4,755,689 A * 7/1988 Porter ..... F02N 11/0851 123/179.1
4,862,123 A * 8/1989 Gray ..... H01H 51/065 335/126
5,015,980 A * 5/1991 Sugiyama ..... H01H 50/163 335/126
5,309,050 A * 5/1994 Morinigo ..... B60G 17/0157 310/14
5,345,901 A * 9/1994 Siegenthaler ..... F02N 11/10 123/179.3
5,521,566 A * 5/1996 Krubsack ..... H01H 51/065 335/126
7,948,338 B2 * 5/2011 Niimi ..... F02N 15/067 335/126
8,305,168 B2 * 11/2012 Cotič et al. ..... H01H 3/001 335/126
8,390,408 B2 * 3/2013 Nawa ..... H01H 3/001 335/131
8,754,556 B2 * 6/2014 Haruno ..... F02N 11/087 310/68 R
2004/0056743 A1 * 3/2004 Maruhashi ..... F02N 15/063 335/126
2007/0194867 A1 * 8/2007 Kurasawa ..... H01H 50/305 335/126
2010/0127806 A1 * 5/2010 Klingel ..... F02N 11/087 335/202
2011/0203410 A1 * 8/2011 Notani ..... F02N 11/0851 74/7 R
2014/0092517 A1 * 4/2014 Sora ..... H01H 50/44 361/160
2014/0311434 A1 * 10/2014 Hirabayashi ..... F02N 11/087 123/179.25
2014/0311435 A1 * 10/2014 Hirabayashi ..... F02N 11/087 123/179.25
2014/0311436 A1 * 10/2014 Hirabayashi ..... F02N 11/00 123/179.25

* cited by examiner

SOLENOID SWITCH

CROSS REFERENCE TO RELATED APPLICATIONS

This non-provisional patent application claims priority under 35 U.S.C. §119(a) from Utility Model Application No. 201420351131.X filed in The People's Republic of China on Jun. 26, 2014, the entire contents of which are hereby incorporated by reference.

FIELD OF THE INVENTION

This invention relates to a solenoid switch and in particular, to a solenoid switch for a starter of an internal combustion engine.

BACKGROUND OF THE INVENTION

A starter for an internal combustion engine has an electric motor which drives the engine via a pinion mechanism which engages a flywheel of the engine to enable the engine to start.

Because the motor draws a large current when driving the engine, a solenoid switch is used to connect the motor to the power source, typically a battery of the vehicle. The solenoid switch includes a movable core, a pull-in coil, a holding coil, contacts and a plunger assembly arranged to connect the contacts. The pull-in coil is connected in series with the motor before it is shorted out by the contacts. The holding coil is arranged in parallel to the pull-in coil and motor. When the starter is switched on, the pull-in coil, the holding coil and the motor are energized. As the motor is energized through the pull-in coil, the motor operates on a reduced voltage. The energized pull-in coil and holding coil generate a magnetic field to move the movable core, thereby causing the pinion to engage with the flywheel and the plunger assembly to connect the contacts, shorting the pull-in coil to fully energize the motor to rotate the engine.

At the instant the solenoid switch is turned on, the pull-in coil and the holding coil both are energized to attract the movable core. Once the movable core has been retracted the force required to hold the movable core in the retracted position is less due to the reduced air gap and thus the pull-in coil can be de-energized to provide more power to the motor while the movable core is held retracted by the magnetic force generated by only the holding coil.

The use of two coils thus saves energy but the solenoid itself is expensive as both coils are made of copper and require many turns to achieve the required magnetic force to operate the solenoid reliably.

SUMMARY OF THE INVENTION

Hence, there is a desire for a solenoid switch for a starter motor having an structure which can meet the operating requirements at a reduced cost.

Accordingly, in one aspect thereof, the present invention provides a solenoid switch, comprising: a housing; two contacts being received in the housing and spaced from each other; a conductive member, the conductive member being isolated from at least one of the two contacts when the solenoid switch is off; a fixed core fixed in the housing; and a movable core coupled to the fixed core; wherein the fixed core comprises an pull-in coil of aluminum wire, a holding coil of copper wire, and a magnetic core, the magnetic core generating an attractive force to the movable core when the pull-in coil and/or holding coil are energized, forcing the movable core to move relative to the fixed core to make the conductive member electrically interconnect the two contacts.

Preferably, the number of turns of the pull-in coil and the holding coil are the same, and the pull-in coil surrounds the holding coil.

Preferably, the fixed core comprises a bobbin, the holding coil and the pull-in coil are wound around the bobbin with the pull-in coil surrounding the holding coil, and the magnetic core being arranged at an end of the bobbin, and the movable core is movably received in the bobbin; and a plunger extends through the magnetic core, an end of the plunger extending through and beyond the magnetic core; and wherein the contacts are fixed in the housing, and the conductive member is mounted on the plunger.

Preferably, a first spring is arranged between an end of the plunger and the housing, and a second spring is arranged between the conductive member and the plunger.

Preferably, a guide tube connects the magnetic core to a magnetic member connecting the magnetic core to the bobbin, a step hole being defined in the magnetic core and comprising a smaller portion and a larger portion facing the conductive member, a flange extending from a middle of the plunger, the flange being received in and having a diameter approximately the same as that of the larger portion of the step hole, the second spring bearing against the flange.

Preferably, the plunger defines an annular slot at an end portion thereof, a locking ring being engaged in the slot, first and second washers being mounted at opposite sides of the conductive member, the first washer, the conductive member and the second washer being stacked on the locking ring in turn, the first spring being sandwiched between the locking ring and the housing, and the second spring being sandwiched between the second washer and the flange.

Preferably, a diameter of the wire of the pull-in coil is larger than a diameter of the wire of the holding coil, and a number of layers of the pull-in coil is greater than that of the holding coil.

Preferably, a magnetic plate is attached to an end of the housing.

Preferably, the housing includes a cylindrical-shaped shell and an end cap coupled to an open end of the shell, the end cap having a battery terminal, a motor terminal, and a switch terminal fixed thereon, the two contacts being connected to the battery terminal and the motor terminal, respectively, two ends of the pull-in coil being connected to the motor terminal and the switch terminal, respectively, and two ends of the holding coil being connected to the switch terminal and ground, respectively.

According to a second aspect, the present invention also provides a starter for an internal combustion engine, comprising: a motor having a rotary shaft, a pinion being fixed to the shaft for engaging with a flywheel of the engine; and a solenoid switch comprising a housing, a fixed core fixedly mounted in the housing, a movable core coupled to the fixed core, rod moving along with the movable core, two contacts spaced from each other, and a conductive member, the rod being connected to the pinion, the conductive member being isolated from at least one of the two contacts when the solenoid switch is off; wherein the fixed core comprises a pull-in coil of aluminum wire, a holding coil of copper wire, and a magnetic core, the motor is connected to the pull-in coil in series, when the pull-in coil is energized, the magnetic core generates an attractive force to move the movable core, thereby the rod moves along with the movable core to make the pinion engage with the flywheel and make the conductive member electrically interconnect the two contacts, whereby the motor drives the pinion to rotate the engine.

Preferably, the solenoid switch comprises a battery terminal, a motor terminal, and a switch terminal, the battery terminal being used for connecting an external power source, the switch terminal being connected to a main switch which is used for connecting the power source, the motor being connected to the motor terminal, the two contacts being connected to the battery terminal and motor terminal, respectively, two ends of the pull-in coil being connected to the motor terminal and the switch terminal, respectively, and two ends of the holding coil being connected to the switch terminal and ground, respectively.

Preferably, the number of turns of the pull-in coil and the holding coil are the same, and the pull-in coil surrounds the holding coil.

Preferably, the fixed core comprises a bobbin, the holding coil and the pull-in coil are wound around the bobbin with the pull-in coil surrounding the holding coil, and the magnetic core being arranged at an end of the bobbin; wherein the movable core is movably received in the bobbin and a plunger extends through the magnetic core, an end of the plunger extending through and beyond the magnetic core; and wherein the contacts are fixed in the housing, and the conductive member is fixed on the end of the plunger.

Preferably, a first spring is arranged between the end of the plunger and the housing, and a second spring is arranged between the conductive member and the plunger.

Preferably, a guide tube connects the magnetic core to a magnetic member, a stepped hole being defined in the magnetic core and comprising a smaller portion and a larger portion facing the conductive member, a flange extending from a middle of the plunger, the flange being received in and having a diameter approximately the same as that of the larger portion of the step hole, the second spring being sandwiched between the flange and the conductive member.

Preferably, the plunger defines an annular slot at the end thereof, a locking ring being engaged in the slot, first and second washers being mounted at opposite sides of the conductive member, the first washer, the conductive member and the second washer being stacked on the locking ring in turn, the first spring being sandwiched between the locking ring and the housing, and the second spring being sandwiched between the second washer and the flange.

Preferably, a diameter of the wire of the pull-in coil is larger than a diameter of the wire of the holding coil, and a number of layers of the pull-in coil is greater than that of the holding coil.

Preferably, the housing includes a cylindrical-shaped shell and an end cap coupled to an open end of the shell, a magnetic plate being arranged in the shell and at an end of the shell opposite to the end cap.

Compared to the starters in the art, the present starter includes a solenoid switch which has an aluminum pull-in coil and a copper holding coil, and the motor connects the pull-in coil in series and connects the holding coil in parallel. At initial turn on of the solenoid, both the pull-in and holding coils are energized to move the movable core, facilitating engagement of the pinion with the flywheel. Once the movable core has moved almost to end of travel, the pull-in coil is shorted by interconnecting of the contacts by the conductive member. Thereafter, the motor is energized by the full voltage of the power supply and able to rotate the engine. During operation, the copper holding coil is always energized keeping the movable core in the retracted position.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
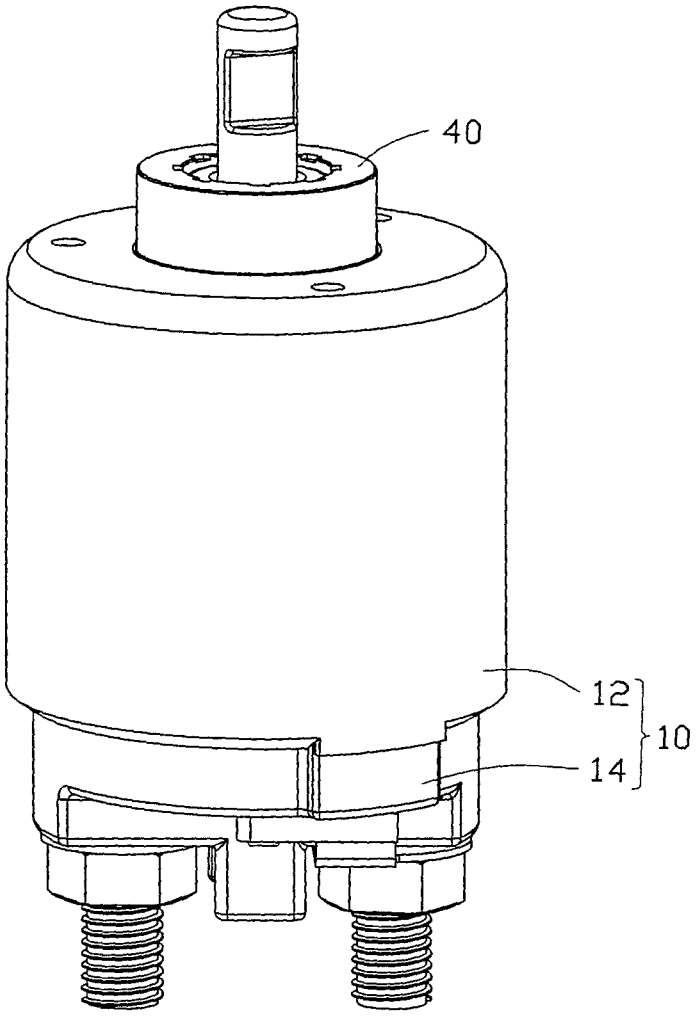
FIG. 1 shows a solenoid switch for a starter motor of an internal combustion engine, according to the preferred embodiment of the present invention.
Figure 2:
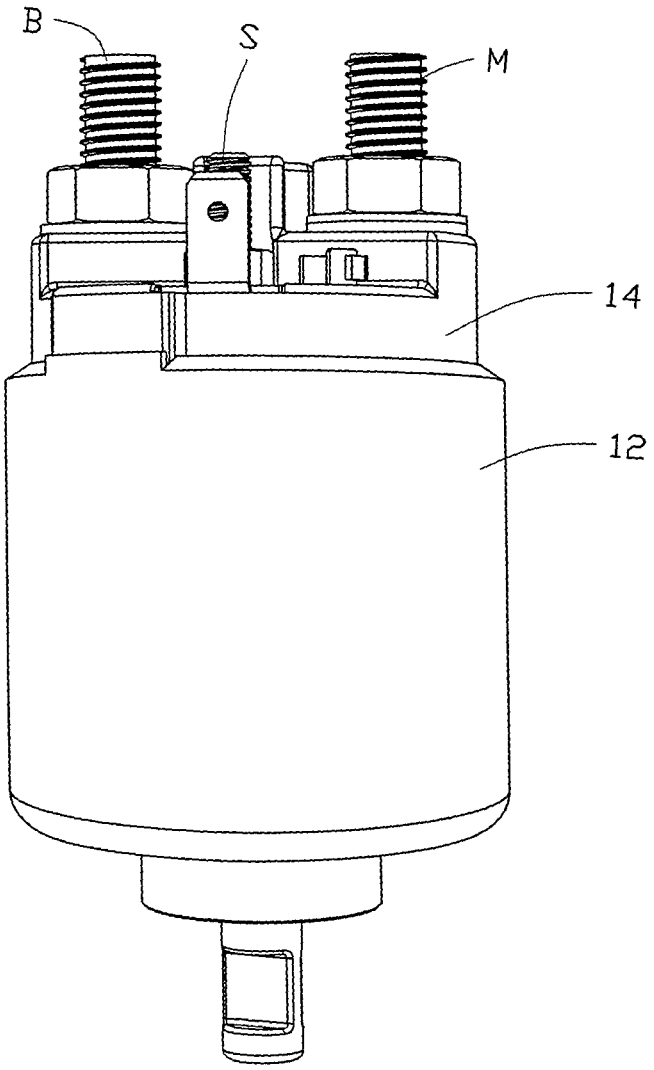
FIG. 2 shows the solenoid switch viewed from another aspect.
Figure 3:
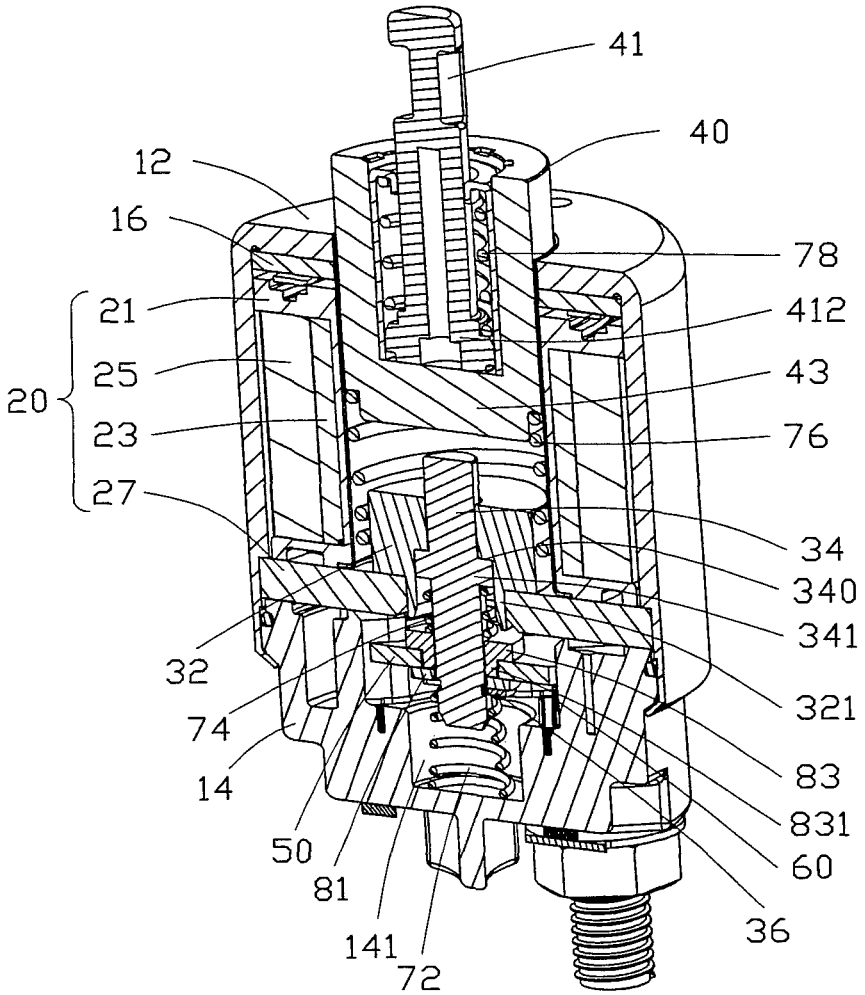
FIG. 3 is a sectional view of the solenoid switch of FIG. 1.

Referring to the Figures, the solenoid switch includes a housing 10, a fixed core 20 received in the housing 10, a movable core 40 received in the fixed core 20, and a spring loaded rod 41 connected to one end of the movable core 40. A plunger 34 is arranged to be moved by the movable core 40. Generally, the motor is connected to the rod of the movable core 40 through a shifting yoke arranged to move the pinion.

The housing 10 includes a shell 12 and an end cap 14. The shell 12 is cylindrical and hollow, with an open end and a closed end. The end cap 14 is fitted to and seals the open end of the shell 12. The shell 12 can be iron formed by deep drawing. The thickness of the shell 12 is about 2.5 mm. The closed end of the shell 12 has a centrally located aperture. The movable core 40 extends through the aperture. A magnetic plate 16 is placed against the closed end of the shell to enhance the magnetic connection between the movable core 40 and the shell 12. The magnetic plate 16 is about 2 mm in thickness, and has a shape and size corresponding to the closed end of the shell 12.

The end cap 14 is an injection molded part of plastic material. As such it provides an insulating base supporting the terminals of the solenoid. The end cap defines a plurality of holes for receiving the terminals. In this embodiment, there are three terminals, namely, a battery terminal B, a motor terminal M, and a switch terminal S. Preferably, the battery terminal B and the motor terminal M each have a diameter larger than that of the switch terminal S to prevent incorrect connection, but also because they must carry the stall current load of the motor, while the switch terminal carries a much lower current load. The battery terminal B and the motor terminal M are preferable formed as copper bolts, and each have a diameter of 8 mm or 10 mm, while the switch terminal S may be an iron bolt and has a diameter of 4 mm or 5 mm. An inner space 141 is defined in the end cap 14 receiving two contacts 60 therein. The two contacts 60 may be electrically and physically fixed to the copper bolts but preferably, the contacts 60 are the heads of the copper bolts forming the battery and motor terminals.

The fixed core 20 is fixed in the housing 10, and includes a bobbin 21, a holding coil 23, a pull-in coil 25, a magnetic member 27 and a magnetic core 32. The holding coil 23 is wound on the bobbin 21. The pull-in coil 25 is also wound on the bobbin but over the holding coil. The holding coil 23 and pull-in coil 25 electrically connected to other components through pins of the bobbin 21. The magnetic member 27 is made of magnetic material, and is connected to one end of the bobbin 21. In this embodiment, the magnetic member 27 is annular. An inner diameter of the magnetic member 27 is less than that of the bobbin 21, and an outer diameter the magnetic member 27 is slightly larger than that of the bobbin 21. An outer periphery of the magnetic member 27 is fixedly sandwiched between a step in the side wall of the shell 12 and the end cap 14. The bobbin 21 is column-shaped and hollow. The magnetic core 32 and the movable core 40 are received in the bobbin 21. The inner diameter of the bobbin 21 is generally the same as the diameter of the aperture of the shell 12.

The movable core 40 is mounted in the bobbin 21, and can move in the bobbin 21 along an axial direction towards/away from the magnetic core 32 of the fixed core 20. The movable core 40 is sleeve-like in structure.

In this embodiment, the number of turns of the holding coil 23 and pull-in coil 25 are the same. The holding coil 23 is wound around the bobbin 21, while the pull-in coil is wound around the holding coil 23. That is, the pull-in coil 25 surrounds the holding coil 23. Preferably, an insulating paper is placed between the pull-in coil 25 and the housing 10 to avoid possible short circuits. In this embodiment, the pull-in coil 25 is aluminum wire, while the holding coil 23 is copper wire. A diameter of the wire of the pull-in coil 25 is larger than that of the holding coil 23, and the number of layers of the pull-in coil 25 is larger than the number of layers of the holding coil 23.

Since the resistance of copper is less than aluminum, the holding coil 23 formed of copper wire has a smaller resistance compared to the pull-in coil 25 formed of aluminum wire, even though the diameter of the aluminum wire is larger. Thus, the holding coil 23 has a relative higher electric current than the pull-in coil 25 when the same voltages are applied to the holding coil 23 and pull-in coil 25. In addition, the pull-in coil 25 surrounds the holding coil 23, the holding coil 23 thus has a shorter length compared to the pull-in coil 25. As copper wire is more expensive than aluminum wire, the disposal of the pull-in coil 25 around the holding coil 23 can lower the amount of copper wire used and accordingly, lower the cost.

The magnetic core 32 is cylindrical with a stepped hole running through its axis. A plunger 34 extends through the magnetic core 32 so as to lay partly within the fixed core and partly outside the fixed core 20. A flange 341 extends outwards from a middle portion of the plunger 34 with a diameter larger than other portions of the plunger 34. An annular slot is defined at an end portion of the plunger 34 outside the fixed core, with a locking ring 36 engaged therein. An outer diameter of the locking ring 36 is larger than the diameter of the plunger 34.

The magnetic core 32 is fixed to the magnetic member 27. An outer diameter of the magnetic core 32 is less than the inner diameter of the bobbin 21, and thus a gap is defined between the bobbin 21 and the magnetic core 32. A step hole 340 is defined in the magnetic core 32 and includes a smaller portion and a larger portion. A flange 341 extends from a middle of the plunger 34. The flange 341 has a diameter approximately the same as that of the larger portion of the step hole 340, the second spring bears 74 against the flange 341. A guide tube 321 extends axially away from the bobbin from an inner periphery of the magnetic core 32. The guide tube 321 has an outer diameter substantially the same as the inner diameter of the magnetic member 27. Preferably, the guide tube is a press fit in the hole of the magnetic member to fix the magnetic core to the magnetic member. The free end of the guide tube may be deformed or crimped to secure the connection. The guide tube 321 forms a guide for the axial movement of the plunger through the magnetic core 32.

The contacts 60 are arranged to be connected together by a conductive member 50 fitted to the external end portion of the plunger 34. The external end of the plunger extends into the inner space 141 of the end cap 14. The conductive member 50 is fitted to the plunger in an insulative manner to avoid shorting the battery contact to ground through the fixed core. The conductive member is preferably a bar formed from copper plate having a central hole through which the plunger passes. The conductive member is sandwiched between two insulating washers. A first washer 81 is disposed about the plunger and rests on the lock ring 36. A second washer 83 is disposed about the plunger and has an annular cylindrical portion 831 which locates within the hole in the conductive member to isolate it from the plunger. The height of the cylindrical portion 831 is substantially the same as a thickness of the conductive member 50 and abuts the first washer 81. The conductive member and washers are slidable along the plunger.

The end of the plunger 34 is spaced from the end cap 14 by a predetermined distance. A first spring 72 is sandwiched between the locking ring 36 and the end cap 14, and a second spring 74 is sandwiched between the second washer 83 and the flange 341 of the plunger 34. Preferably, the first and second springs 72, 74 are helical springs. When the plunger is moved down by the movable core, the conductive member contacts the contacts 60 to short them together. However, to ensure good contact over the life of the solenoid, the plunger over runs and the conductive member and the two washers slide along the plunger but the conductive member is help firm against the contacts by the second spring 74. The first spring 72 ensures that the plunger returns to the normal position with the flange 341 pressed against the step in the magnetic core 32 when the movable core releases the plunger, thus removing the conductive member from contact with the contacts 60.

A third spring 76 urges the movable core 40 away from the magnetic core 32 and out of the housing 10. A protrusion 431 extends axially from the bottom of the movable core 43. The protrusion 431 has a diameter slightly less than the outer diameter of the movable core 43. Preferably, the third spring 76 is a helical spring, which has one end surrounding and connecting the magnetic core 32, and the other end surrounding and connecting the protrusion 431 of the movable core 43, thus capturing the movable core within the bobbin 21.

In this embodiment, the movable core 40 is tube-like with a closed end and has a spring loaded rod 41 fitted in a central passage for engaging with a shifting yoke of the starter, arranged to move the pinion into engagement with the flywheel of the engine. An inner diameter of the movable core 40 is larger than a diameter of the rod 41 and an outer diameter is approximately the same as the inner diameter of the bobbin 21. The passage has a diameter substantially the same as that of the rod 41. An annular platform 412 extends from the bottom of the rod 41. A diameter of the platform 412 is approximately the same as the inner diameter of the passage. A fourth spring 78 is arranged to urge the rod into the passage and a spring retainer 42 is pressed into the passage to retain the spring within the passage. In this embodiment, the fourth spring 78 is a helical spring, which is mounted around the rod 41 with two ends thereof abutting the platform 412 and an outer end of the spring retainer 42, respectively.

When the starter is off, the main switches ST and NT are open. In such a situation, under the supporting of the first spring 72, the movable core 40 is above and spaced from the magnetic core 32 and the plunger 34, and the conductive member 50 is spaced from the two contacts 60. That is, the two contacts 60 are not connected, and the pull-in coil 25, the holding coil 23 and the motor have no current. Accordingly, the motor is off, and there is no magnetic force between the magnetic core 32 of the fixed core 20 and the movable core 40.

Figure 4:
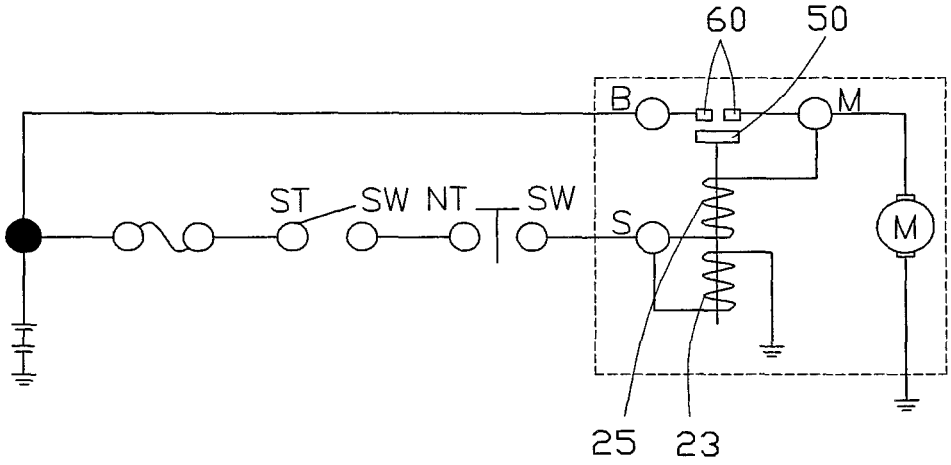
FIG. 4 is a schematic circuit diagram of the starter.

The two ends of the pull-in coil 25 are connected to the motor terminal M and the switch terminal S, respectively, and the two ends of the holding coil 23 are connected to the battery terminal B and the ground, respectively. Referring to FIG. 4, the battery terminal B is connected to the positive pole of a power source, such as a battery, the switch terminal S is connected to the positive pole through two main switches ST and NT, (although any number of main switches may be used) and the motor is connected between the motor terminal M and the negative pole of the power source. Thus, the pull-in coil 25 and the motor are connected in series, and together are parallel to the holding coil 23.

Figure 5:
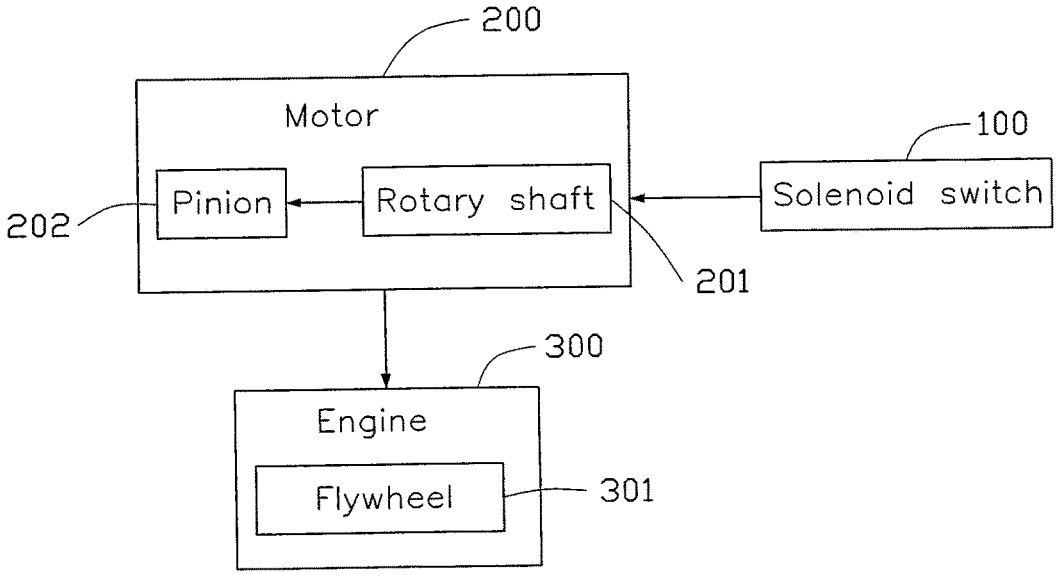
FIG. 5 shows a structural view of a motor, the solenoid switch, and an engine, according to the preferred embodiment of the present invention.

Referring to FIG. 5, when the ignition switch is turned on to start the engine 300, the main switches ST and NT are closed. The power source, the pull-in coil 25 and the motor 200 cooperatively form a first closed loop, which is parallel to a second closed loop formed by the power source and the holding coil 23. Since the pull-in coil 25 is aluminum wire and has a higher resistance, the current in the first closed loop is small. Thus the motor may operate slowly. Synchronously, current in the holding coil 23 of the second closed loop is high since the holding coil 23 is copper wire and has small resistance. That is, both of the pull-in coil 25 and the holding coil 23 have currents flowing there through, and both generate magnetic fields. The magnetic fields superposed with each other, and thus are strong enough to attract and move the movable core 40 to the magnetic core 32.

During downwards movement of the movable core 40, the rod 41 moves downwards along with the movable core 40, which moves the shifting yoke, thereby the pinion 202 fitted on the shaft 201 of the motor 200 engages with the flywheel 301 of the engine 300. Since the pull-in coil 25 of aluminum wire has small current, the motor 200 operates at lower speed at the beginning of starting the starter, thereby the engagement of the pinion 202 and the flywheel 301 is easy and quick without kick back.

The movable core 40 continues to move to make contact with the plunger 34, pressing the plunger through the magnetic core 32, bringing the conductive member 50 into contact with the two contacts 60. That is, the battery terminal B and the motor terminal M are electrically connected through the contacts 60 and the conductive member 50. At this time the pull-in coil 25 connected between the positive pole of the power source and the motor terminal M is shorted. That is, the motor is directly connected between the positive and negative poles of the power source, and is fully energized to have sufficient power to rotate the engine. Meanwhile, the holding coil 23 is still energized.

After starting of the engine, the main switches ST and NT are opened. Connection of the holding coil 23, and pull-in coil 25 to the power source is thus cut off and the solenoid returns to its initial state.

During starting of the engine, the holding coil 23 is always energized. Since the holding coil 23 is copper wire and has small resistance, the magnetic field of the holding coil 23 is strong enough to maintain the movable core 40 in the retracted position, keeping contact of the conductive member 50 and contacts 60 stably, thereby ensuring starting of the engine. In addition, the springs 72, 74, 76, 78 are arranged between the plunger 34 and the end cap 14, the conductive member 50 and the magnetic core 32, the magnetic core 32 and the movable core 40, and the movable core 40 and the rod 41, which can buffer impulsive force during movement of the movable core 40, avoiding damage of components of the starter.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. A solenoid switch, comprising:

a housing comprising a cylindrical-shaped shell and an end cap coupled to an open end of the shell, the end cap having a battery terminal, a motor terminal, and a switch terminal fixed thereon;

two contacts being received in the housing and spaced from each other, the two contacts being connected to the battery terminal and the motor terminal, respectively;

a conductive member, the conductive member being isolated from at least one of the two contacts when the solenoid switch is off;

a fixed core fixed in the housing; and a movable core coupled to the fixed core;

a plunger connected to the conductive member and spaced from the movable core;

wherein the fixed core comprises a pull-in coil of aluminum wire, a holding coil of copper wire, and a magnetic core, two ends of the pull-in coil being connected to the motor terminal and the switch terminal, respectively, two ends of the holding coil being connected to the switch terminal and ground, respectively, the magnetic core generating an attractive force to the movable core when the pull-in coil and/or holding coil are energized, forcing the movable core to move relative to the fixed core to make the conductive member electrically interconnect the two contacts.

2. The solenoid switch of claim 1, wherein the number of turns of the pull-in coil and the holding coil are the same, and the pull-in coil surrounds the holding coil.

3. The solenoid switch of claim 1, wherein the fixed core comprises a bobbin, the holding coil and the pull-in coil are wound around the bobbin with the pull-in coil surrounding the holding coil, and the magnetic core being arranged at an end of the bobbin, and the movable core is movably received in the bobbin; and the plunger extends through the magnetic core, an end of the plunger extending through and beyond the magnetic core; and wherein the contacts are fixed in the housing, and the conductive member is mounted on the plunger.

4. The solenoid switch of claim 3, wherein a first spring is arranged between an end of the plunger and the housing, and a second spring is arranged between the conductive member and the plunger.

5. The solenoid switch of claim 4, wherein a guide tube connects the magnetic core to a magnetic member connecting the magnetic core to the bobbin, a step hole being defined in the magnetic core and comprising a smaller portion and a larger portion facing the conductive member, a flange extending from a middle of the plunger, the flange being received in and having a diameter approximately the same as that of the larger portion of the step hole, the second spring bearing against the flange.

6. The solenoid switch of claim 5, wherein the plunger defines an annular slot at an end portion thereof, a locking ring being engaged in the slot, first and second washers being mounted at opposite sides of the conductive member, the first washer, the conductive member and the second washer being stacked on the locking ring in turn, the first spring being sandwiched between the locking ring and the housing, and the second spring being sandwiched between the second washer and the flange.

7. The solenoid switch of claim 1, wherein a diameter of the wire of the pull-in coil is larger than a diameter of the wire of the holding coil, and a number of layers of the pull-in coil is greater than that of the holding coil.

8. The solenoid switch of claim 1, wherein a magnetic plate is attached to an end of the housing.

9. A starter for an internal combustion engine, comprising:

a motor having a rotary shaft, a pinion being fixed to the shaft for engaging with a flywheel of the engine; and a solenoid switch comprising a housing, a fixed core fixedly mounted in the housing, a movable core coupled to the fixed core, rod moving along with the movable core, two contacts spaced from each other, and a conductive member, the rod being connected to the pinion, the conductive member being isolated from at least one of the two contacts when the solenoid switch is off;

wherein the fixed core comprises a pull-in coil of aluminum wire, a holding coil of copper wire, and a magnetic core, the motor is connected to the pull-in coil in series, when the pull-in coil is energized, the magnetic core generates an attractive force to move the movable core, thereby the rod moves along with the movable core to make the pinion engage the flywheel and make the conductive member electrically interconnect the two contacts, whereby the motor drives the pinion to rotate the engine.

10. The starter of claim 9, wherein the solenoid switch comprises a battery terminal, a motor terminal, and a switch terminal, the battery terminal being used for connecting an external power source, the switch terminal being connected to a main switch which is used for connecting the power source, the motor being connected to the motor terminal, the two contacts being connected to the battery terminal and motor terminal, respectively, two ends of the pull-in coil being connected to the motor terminal and the switch terminal, respectively, and two ends of the holding coil being connected to the switch terminal and ground, respectively.

11. The starter of claim 9, wherein the number of turns of the pull-in coil and the holding coil are the same, and the pull-in coil surrounds the holding coil.

12. The starter of claim 9, wherein the fixed core comprises a bobbin, the holding coil and the pull-in coil are wound around the bobbin with the pull-in coil surrounding the holding coil, and the magnetic core being arranged at an end of the bobbin; wherein the movable core is movably received in the bobbin and a plunger extends through the magnetic core, an end of the plunger extending through and beyond the magnetic core; and wherein the contacts are fixed in the housing, and the conductive member is fixed on the end of the plunger.

13. The starter of claim 12, wherein a first spring is arranged between the end of the plunger and the housing, and a second spring is arranged between the conductive member and the plunger.

14. The starter of claim 13, wherein a guide tube connects the magnetic core to a magnetic member, a stepped hole being defined in the magnetic core and comprising a smaller portion and a larger portion facing the conductive member, a flange extending from a middle of the plunger, the flange being received in and having a diameter approximately the same as that of the larger portion of the step hole, the second spring being sandwiched between the flange and the conductive member.

15. The starter of claim 14, wherein the plunger defines an annular slot at the end thereof, a locking ring being engaged in the slot, first and second washers being mounted at opposite sides of the conductive member, the first washer, the conductive member and the second washer being stacked on the locking ring in turn, the first spring being sandwiched between the locking ring and the housing, and the second spring being sandwiched between the second washer and the flange.

16. The starter of claim 9, wherein a diameter of the wire of the pull-in coil is larger than a diameter of the wire of the holding coil, and a number of layers of the pull-in coil is greater than that of the holding coil.

17. The starter of claim 9, wherein the housing includes a cylindrical-shaped shell and an end cap coupled to an open end of the shell, a magnetic plate being arranged in the shell and at an end of the shell opposite to the end cap.

* * * * *